United States Patent [19]

Story

[11] Patent Number: 4,821,546

[45] Date of Patent: Apr. 18, 1989

[54] TWO-STEP SUPERPLASTIC FORMING METHOD

[75] Inventor: James M. Story, Plum Borough, Pa.

[73] Assignee: Aluminum Company of America, Pittsburgh, Pa.

[21] Appl. No.: 169,994

[22] Filed: Mar. 18, 1988

[51] Int. Cl.[4] ..... B21D 22/00; B21D 26/02

[52] U.S. Cl. ..... 72/60; 29/421.1

[58] Field of Search ..... 72/38, 60, 63, 364, 72/379, 709, 54; 29/421 R

[56] References Cited

U.S. PATENT DOCUMENTS 2,728,317 12/1955 Clenvenger et al. ..... 72/60
3,340,101 9/1967 Fields, Jr. et al. ..... 148/11.5
4,405,986 9/1977 Laycock et al. ..... 72/60
4,409,809 10/1983 Buchanan ..... 72/60
4,644,626 2/1987 Barnes et al. ..... 29/421 R

*Primary Examiner*—E. Michael Combs
*Attorney, Agent, or Firm*—Elroy Strickland

[57] ABSTRACT

A method of forming an object having a relatively deep cavity from a superplastic metallic blank wherein a preform having a bottom portion and sides sloping upwardly and outwardly therefrom is first superplastically formed in a female mold. The preform is then attached to a male mold with the bottom portion of the preform in a snug fit with a top portion of the male mold which has outside dimensions equal to the cavity in the object and thereafter the preform is superplastically forced against the male mold to form the desired object.

5 Claims, 3 Drawing Sheets

TWO-STEP SUPERPLASTIC FORMING METHOD

BACKGROUND OF THE INVENTION

This invention relates to forming metal shapes. More particularly, it relates to forming those metals, alloys, and composites that are identified as superplastic.

A superplastic metal or alloy is one which, under certain conditions, exhibits a very low resistance to deformation and a high plasticity. Such metals can be deformed to an extraordinary degree without failure as compared to conventional metals or alloys, and increasing attention is being paid to superplastic alloys and methods of forming them.

One of the earliest patents to describe superplastic forming of metals is Fields, Jr. et al U.S. Pat. No. 3,340,101. This patent describes methods whereby a superplastic metal blank clamped adjacent a female or male forming surface is heated to a temperature suitable to place the blank in a superplastic state. A uniform fluid pressure, such as air for example, is applied at an appropriate rate against the surface to press or force the sheet into contact with the forming surface. A pressure differential across the sheet is necessary to generate the required air pressure, which can be provided by creating a vacuum or directing air pressurized at a value higher than atmospheric against the sheet.

A number of advantages of superplastic forming have been noted. Severe forming can be accomplished in a single step rather than several steps. In addition, if one or more separate steps are required to form a shape by a conventional forming method, one or more intermediate anneals might also be required, which superplastic forming can eliminate. Tooling costs are relatively low since usually only a single male or female die is required, as compared with matched die sets or' multiple tools, which may be required with conventionally forming. Tooling costs are also usually lower because deformation forces required to effect superplastic forming are substantially less than required for conventional forming.

On the other hand, superplastic forming is often slower than forming conventionally. Another problem encountered in superplastic forming certain types of shapes is nonuniform thinning as the part is being formed. In superplastic forming, only unsupported metal is deformed; that is, metal' which is not touching the die surface. When superplastic forming a relatively deep shape in a female die, for example, there can be a very substantial difference in thickness between the metal in the sidewalls that along the bottom, and, more particularly, the metal in the corners.

Laycock et al U.S. Pat. No. 4,045,986 proposes a solution to the problem of nonuniform thinning. In a first step of the proposed solution, a suitably heated blank is firmly clamped around its periphery. A first uniform' fluid pressure is then applied against the sheet at an appropriate rate to force it into contact with a female mold which has a shape intermediate the final desired shape. In an alternative, the sheet may be forced against a flat surface spaced away from the plane of the clamped blank periphery. The flat surface may be stationary or advanced in opposition to the fluid pressure. This first forming step provides a preform for further forming around a male mold. After making the preform, application of the fluid pressure is stopped and the female mold on the flat surface is withdrawn. Then a male mold contoured to the final desired shape is advanced against the preform from the side opposing the female mold until the preform is in contact with a substantial area of the male mold. A reverse uniform fluid pressure opposite from the first pressure is then applied against the sheet as the male mold continues to advance until the preform is completely shaped around the male mold. Timing of the application of this reverse pressure, variations in the pressure differential, and speed of advance of the male mold may be adapted to suit particular requirements. According to the patent disclosure, this method minimizes nonuniform thinning which might otherwise occur in superplastic forming a part.

SUMMARY OF THE INVENTION

It is an objective of this invention to provide a method of superplastic forming a part having a substantially uniform wall thickness.

By a method of this invention, a fluid pressure is applied over the surface of a suitably sized superplastic blank to press it against a female mold to form a preform. The preform is then positioned over a male mold having a finally desired shape and a fluid pressure is applied over the surface of the preform to conform it to the contour of the male mold.

This and other objectives and advantages of this invention will be better understood with reference to the following Description of a Preferred Embodiment of the Invention and accompanying drawings.

DESCRIPTION OF A PREFERRED EMBODIMENT

For ease of description, a preferred embodiment of this invention will be described with reference to forming a relatively long trough-like object having a rectangular cross section. It is to be understood, however, that the invention is not limited to any particular shape or size of section to be formed.

Figure 1:
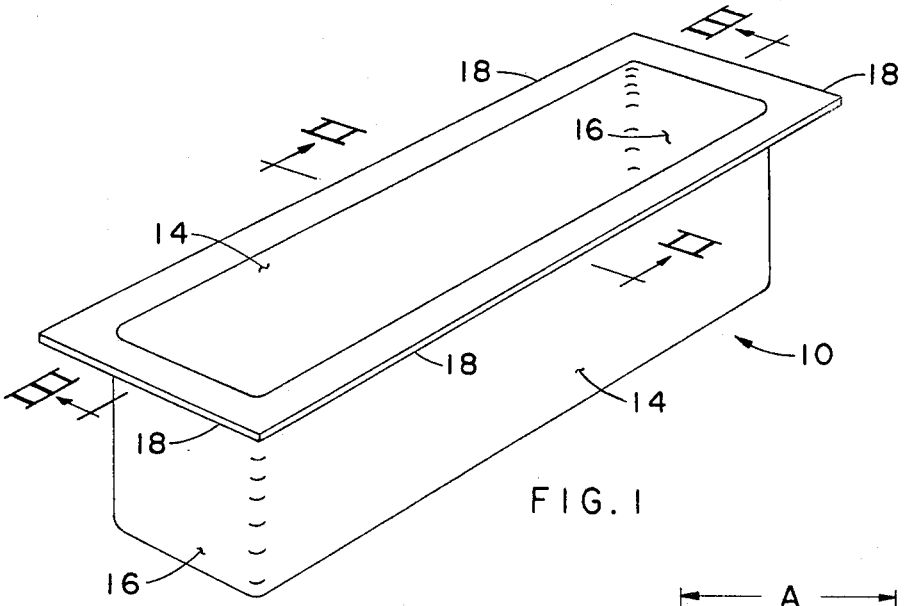
FIG. 1 is a perspective view of a flanged trough-like object suitable for superplastic forming by a method of this invention.
Figure 2:
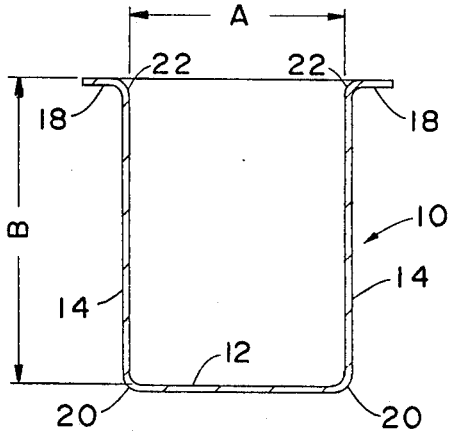
FIG. 2 is a cross-section of the object shown in FIG. 1 along section line II—II.
Figure 3:
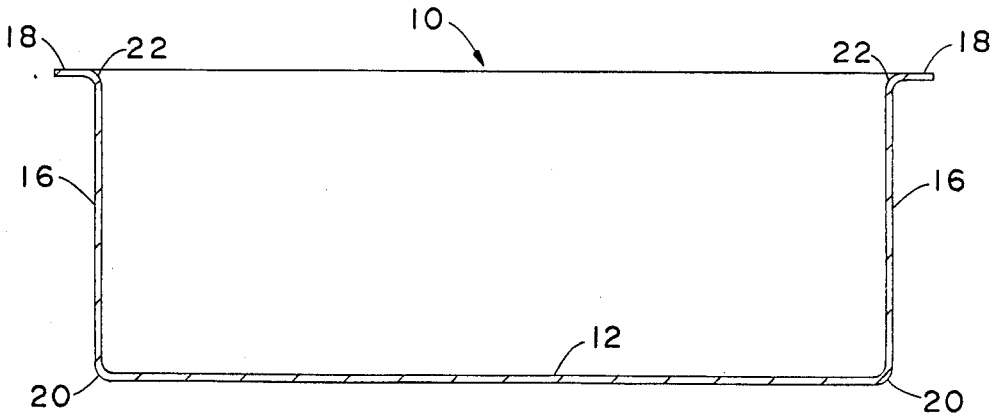
FIG. 3 is a cross-section of the object shown in FIG. 1 along section line III—III.

FIGS. 1, 2 and 3 show a rectangular-shaped trough-like object 10. It has a bottom wall 12, sidewalls 14, 14 and end walls 16, 16 projecting upwardly therefrom and flanges 18, 18, 18, 18 projecting outwardly from the sidewalls and end walls. To facilitate forming when making a relatively deep rectangular object of this kind, liberal radii are provided at the connections 20, 20, 20, 20 between the bottom wall and sidewalls, and the bottom wall and end walls, and the connections 22, 22, 22, 22 between the flanges of the sidewalls and the flanges and the end walls. Although providing a liberal radius does help in forming deep sections by superplastic forming methods, the depth of the object might be limited by possible fracture or excessive thinning of corner portions if it was formed by a conventional superplastic method using only a female mold. For example, assume the object width dimension A is 2.5 inches and the depth dimension B is 3.5 inches. Further assume that each of the flanges 18 projects outwardly 0.75 inch from the sidewalls 14 and end walls 16 and that the radius of the connection 22 between the flanges and end walls and sidewalls is 0.25 inch. Also assume that the radius of the connection 20 between the bottom wall 12 and each of the sidewalls 14 and end walls 16 is 0.050 inch. By using a mathematical model similar to that described in Hamilton et al U.S. Pat. No. 4,233,831, which is hereby incorporated by reference, it is possible to calculate the wall thickness at specific points of an object formed in a female die from a blank of a particular superplastic material of a certain thickness. If the object shown in FIG. 1 having the foregoing dimensions is made from a superplastic material 0.060 inch thick, the calculated thickness at various points is as follows: The thickness at the corners between the sidewall, end wall and flanges is 0.039 inch; at the midpoint of the bottom wall it is 0.0116 inch; and at the corners between the sidewall, end wall and bottom wall it is 0.0094 inch. In conventional superplastic forming of the object in a female die, the last formed portions are the bottom corners, and very substantial thinning from the original blank thickness occurs in these areas.

Figure 4:
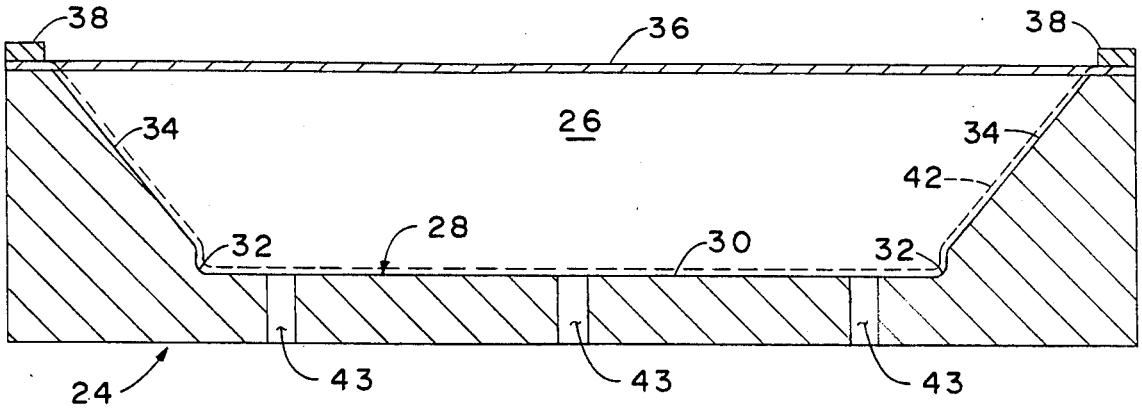
FIG. 4 is a cross-section of the length of a preform mold in combination with a metal blank attached thereto for use in making an object by a method of this invention.
Figure 5:
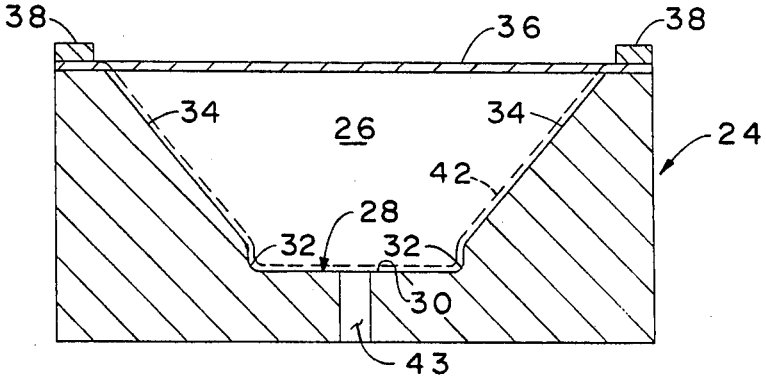
FIG. 5 is a sectional view across the width of the preform mold of FIG. 4 and metal blank attached thereto.

Superplastic forming an object by a method of this invention provides a wall in which there is significantly less thinning and, in addition, the wall is substantially more uniform in thickness. In a first step, a preform shape is formed. Referring to FIGS. 4 and 5, preform die 24 has a central cavity 26 defined by a bottom surface 28 which includes a flat rectangular portion 30 and an arcuate portion 32 extending away therefrom around its periphery. Sloping surfaces 34 extend upwardly and outwardly from the arcuate portions 32 on both sides and both ends. The preform die 24, therefore, has within it a truncated pyramid-like shaped cavity. A suitable superplastic metal blank 36, such as Aluminum Association aluminum alloy 7475-02, for example, is heated to a temperature suitable for superplastic forming and attached firmly in place across the opening of cavity 26 with clamps. In the alternative, blank 36 can be heated after being clamped in place.

Typically the blank is clamped in place by utilizing a hydraulic press or hydraulic or pneumatic cylinders to apply a downward force against the blank through a hold-down tool 38. A sufficient fluid pressure, such as air, for example, is then applied at a rate suitable for superplastic forming of the material against the surface of the blank 36 to press it against the mold cavity surface to form a preform 42 (FIGS. 4 and 5) having a truncated pyramid-like shape as indicated by dashed lines. The pressure may be applied across the outer surface of blank 36 from a pressurized air source or by lowering the pressure in cavity 26 with a vacuum pump. One or more openings 43 extending from the cavity to the mold exterior are provided as needed to either lower the pressure within the cavity with the vacuum pump or exhaust air as pressurized air is applied against the blank exterior.

Figure 6:
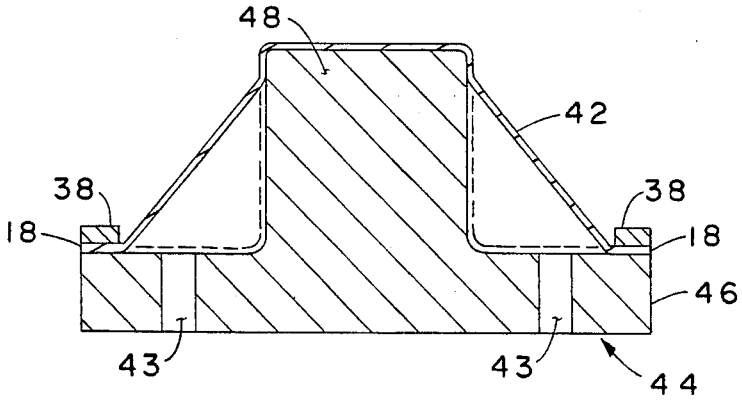
FIG. 6 is a sectional view across the width of a male forming mold suitable for use in making an object by a method of this invention, with a preform made in the mold shown in FIGS. 4 and 5 attached thereto.
Figure 7:
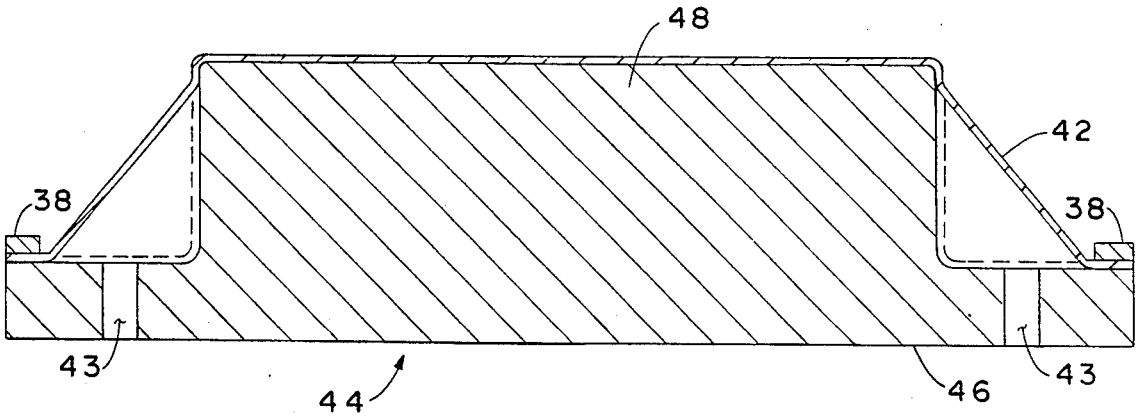
FIG. 7 is a cross-sectional view along the length of the male mold preform of FIG. 6.

The preform 42 is now removed from the mold cavity 26 and positioned on a male mold 44, as shown in FIGS. 6 and 7. The male mold 44 has a base 46 and a rectangular projection 48 extending upwardly therefrom. The upward projection 48 is shaped and dimensioned as the mold to form the rectangular space in the trough-like object 10. Since the bottom portion 30 of the preform 42 is formed in the preform mold 24 to the desired finished size and no further forming of that portion is required, it fits over the upper end of the projection 48 in a uniformly supported snug fit. Providing such a snug fit prevents localized strains in the corners which could lead to premature failure when the preform is further formed to conform to the male mold, as will now be discussed. The flanges 18 are clamped or attached to the mold base 46 with a hold-down tool 38. Either before attaching to the mold 44 or thereafter, the preform 42 is heated to a suitable superplastic forming temperature and a fluid pressure is then applied to the surface of the preform at a rate suitable for superplastic forming of the material to force the preform 42 against the male mold surface. Its position after forming is shown by a dashed line in FIGS. 6 and 7. The pressure necessary to effect the forming can be supplied from a compressed air source against the preform exterior or by lowering the pressure in the space between the preform 42 and mold 44. One or more openings 43 are provided through the mold base 46 around the projection 48 to either lower the pressure in the space between the preform 42 and mold 46 or exhaust air out the space as the preform is being formed. After forming the preform to conform it to the male mold 44 as shown, the clamps are removed and the object removed from the mold. A suitable method for removing the object from the projection 48 is disclosed in pending U.S. patent application Ser. No. 856,023, filed Apr. 25, 1986 now U.S. Pat. No. 4,741,197 issued on May 3, 1988. As shown, a plate in the cavity of the forming die, and a ring on the periphery of die are moved simultaneously to strip the object from the die. It is to be noted that sufficient draft, such as 2° for example, is provided on the upward projection 48 to facilitate stripping the object therefrom. The final step in forming the object 10 shown in FIGS. 1 and 2 is to shear off any excess material that is not needed for the finished flanges 18.

One of the differences between forming an object by a method of this invention and by a conventional superplastic practice in which a blank is forced into a female mold cavity in a single step is the difference in blank sizes to form the objects. The blank for conventionally forming the object 10 in FIGS. 1 and 2 has a width equal to the width of the opening A plus the flange widths and a length equal to the length of the opening plus the flange widths. If the previously described 2.5″×3.5″ rectangular-shaped object has a 24-inch inside length and the same 0.75 inch flange width, then the blank for conventional superplastic forming would be 4″×25.5″. Forming the same sized object, excepting thickness, by a method of this invention will require a larger blank size with the exact difference depending on a number of variables. For example, the properties of the superplastic material being used, the depth-to-width ratio of the object to be formed, and the minimum thickness of material that can be tolerated are at least some of the variables which may affect the blank size. If it is assumed that a 2.5"×3.5"×24" trough 10 like that shown in FIG. 1 is to be made by a two-step process of this invention with the sloping surface 34 of the preform mold 24 angling downwardly at an angle of 40° with respect to vertical, the gap across the cavity 26 at the top of the mold would be 7.53 inches and the width of the blank would be 7.53 inches plus the flange widths or 9.03 inches. The length of the blank would be 29.03 inches plus the flange widths or 30.53 inches. In this example, therefore, the starting blank would be approximately 170% larger in surface area in forming the object by a method of this invention versus forming it by a conventional superplastic method. The larger blank size, however, is offset by a reduction in thickness that may be made in the blank because the maximum thinning of an object formed by a method of this invention may be substantially less than an object formed by a conventional method of single-step forming in a female mold. As noted earlier, the minimum thickness of the rectangular object 10 when formed by a conventional superplastic method in a female mold was 0.0094 inch. If a blank of the same material and thickness is formed by a method of this invention, the calculated minimum thickness of the object will be 0.0170 inch. The minimum thickness value of 0.0170 inch was calculated using a mathematical model similar to that taught by Hamilton et al. U.S. Pat. No. 4,233,831. From these comparisons, it may be seen that the starting thickness of a blank used to form a relatively deep rectangular trough-like object can be substantially less for superplastic forming by a method of this invention than that required to form the same object with a conventional superplastic method using only a female mold if the limiting criterion is the minimum thickness of material in the finished object. In addition to the minimum thickness being substantially improved, the object formed by a method of this invention is more uniform in thickness. For example, the thickness at the center of the bottom wall 12 would be expected to be 0.0363 inch instead of 0.0116 inch when formed by a conventional superplastic method, and the thickness at radius 22 would be 0.017 inch versus 0.0390 inch when forming the object by a conventional superplastic forming method using a female mold only.

Figure 8:
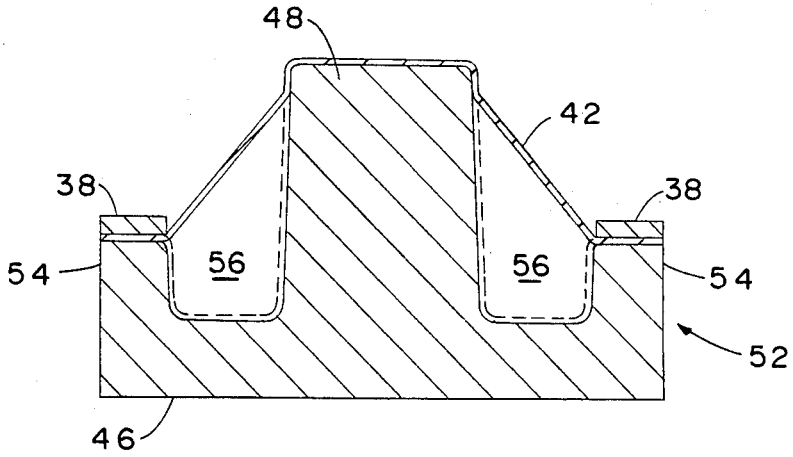
FIG. 8 is a sectional view across the width of an alternate embodiment of a male mold suitable for use in a method of this invention.

In some circumstances, the depth of a preform 42 such as that shown in FIG. 5, for example, may be extended when finally forming it over a male mold in which case the differences in blank sizes to form the finished part would be less. Referring now to FIG. 8, the preform 42 is formed in the same manner as that previously described in connection with FIG. 5. The male mold 52 is different, however, in that an upstanding wall 54 is provided around the periphery of the mold. Final forming of the preform 42 is effected by heating the preform to a temperature suitable to place the preform in a superplastic state and applying a fluid pressure across its surface at a proper rate to superplastically form the preform into the cavity 56 between the wall 54 and the central rectangular projection 48 and force it against the mold as shown by the dashed lines.

If it is again assumed that a trough-like object like that shown in FIG. 1 having a cavity of 2.5"×3.5"×24" and 0.75-inch flanges is to be made, and it is further assumed that the height of the wall 54 from the base 46 of the male mold shown in FIG. 8 is 1½ inches, the blank from which the preform 42 is made would be 6.52"×28.02" and have a surface area of 188 square inches, as contrasted with a blank of 276 square inches to make an object using the male mold shown in FIG. 5. The surface area of the blank required to form an object on the mold shown in FIG. 8 would, therefore, be 32% than the surface area of the blank required to form the same size object (exclusive of thickness) using the mold shown in FIG. 6.

It is also evident that the blank size for use in a method of this invention can be reduced or minimized by keeping the angle between vertical and the sloping surface 34 of the preform mold 24 to a minimum. The optimum angle will vary with the controlling design criteria such as the width-to-depth ratio of the opening in the object, the minimum thickness that can be tolerated, and the degree of uniformity of thickness desired.

While the invention has been described in terms of preferred embodiments, the claims appended hereto are intended to encompass all embodiments which fall within the spirit of the invention.

What is claimed is:

1. A method of forming a metallic object comprising:

providing a preform mold having a central cavity which includes a bottom surface having side edges and side surfaces extending upwardly and outwardly therefrom to a top surface;

providing a blank of superplastic metallic material having a central portion and a peripheral flange portion therearound in a condition for superplastic forming;

clamping the flange portion to the top surface of the preform mold with the central portion covering the central cavity;

applying a fluid pressure to the surface of the blank outward of the mold cavity at a rate to cause the central portion to superplastically deform and contact the mold cavity surfaces and thereby form a preform having a bottom portion, side portions, and a flange projecting outward from the side portions;

providing an object forming mold having forming surfaces and which includes a base and a central portion projecting upwardly therefrom which has a top forming surface portion conforming to the inside of the bottom portion of the preform;

heating the preform to a temperature sufficient to establish a state suitable for superplastic forming and clamping the preform to the object forming mold with the inside surface of the bottom portion positioned against the top surface of the central portion; and applying a fluid pressure against the surface of the preform outward of the object forming mold at a rate which is suitable to superplastically deform the side portions of the preform and thereby cause the preform to contact the forming surfaces of the mold.

2. A method as claimed in claim 1 wherein the blank is forced against the bottom surface of the preform mold, which is substantially planar and against arcuate surfaces extending away from the bottom surface which connect with the side surface of the preform mold.

3. A method as claimed in claim 1 wherein the blank is forced to a bottom surface of the preform mold and to end edges and end surfaces extending upwardly and outwardly therefrom to the top surface.

4. A method as claimed in claim 1 wherein the preform is forced against the object forming mold including a wall portion extending upwardly from the base of the mold and spaced away from the central portion of the mold.

5. A method of forming a hollow body having a closed end, comprising:

providing a blank having a first side and an opposing second side;

positioning the blank on a preform die having a central cavity with the first side of the blank facing the die;

superplastically forming the blank into a preform having a bottom end by forcing the blank to contact the die surface defining the central cavity;

removing the preform from the preform die and positioning the preform on a second die with the second side of the blank facing the die and the bottom end of the blank contacting the end of an upstanding male portion of the die; and superplastically forming the preform into a hollow body having a closed end by forcing the preform to contact and conform to the shape of the upstanding male portion of the second die.

* * * * *